US011083269B2

(12) United States Patent
Tokunaga et al.

(10) Patent No.: US 11,083,269 B2
(45) Date of Patent: Aug. 10, 2021

(54) WIG FOUNDATION NET

(71) Applicant: Aderans Company Limited, Tokyo (JP)

(72) Inventors: Teruyuki Tokunaga, Urayasu (JP); Takashi Kataoka, Sabae (JP); Kaori Yuhi, Sakai (JP)

(73) Assignee: ADERANS COMPANY LIMITED, Tokyo (JP)

( * ) Notice: Subject to any disclaimer, the term of this patent is extended or adjusted under 35 U.S.C. 154(b) by 658 days.

(21) Appl. No.: 15/750,663

(22) PCT Filed: Aug. 4, 2016

(86) PCT No.: PCT/JP2016/072999
§ 371 (c)(1),
(2) Date: Feb. 6, 2018

(87) PCT Pub. No.: WO2017/026376
PCT Pub. Date: Feb. 16, 2017

(65) Prior Publication Data

US 2020/0085125 A1 Mar. 19, 2020

(30) Foreign Application Priority Data

Aug. 7, 2015 (JP) ..... JP2015-157436

(51) Int. Cl.
*A45D 8/40* (2006.01)
*A41G 3/00* (2006.01)
*A41G 5/00* (2006.01)

(52) U.S. Cl.
CPC ..... *A45D 8/40* (2013.01); *A41G 3/005* (2013.01); *A41G 5/0053* (2013.01)

(58) Field of Classification Search
CPC .. A41G 3/0008; A41G 3/0041; A41G 3/0016; A41G 3/00; A41G 3/005; A42B 1/04; A45D 8/40
(Continued)

(56) References Cited

U.S. PATENT DOCUMENTS 3,046,999 A * 7/1962 Lint ..... A41G 3/0016 132/54
3,521,648 A * 7/1970 Capparelli ..... A41G 3/00 132/53
(Continued)

FOREIGN PATENT DOCUMENTS

CN 204032469 12/2014
CN 204292285 4/2015
(Continued)

OTHER PUBLICATIONS

Extended European Search Report dated Jan. 16, 2019 in corresponding European Patent Application No. 16835073.4.
(Continued)

*Primary Examiner* — Tatiana L Nobrega
*Assistant Examiner* — Sarah Woodhouse
(74) *Attorney, Agent, or Firm* — Wenderoth, Lind & Ponack. L.L.P.

(57) ABSTRACT

There is provided a wig foundation net 2 worn under a wig, comprising: a first net portion 4 formed with a first elastic net-shaped member 12; and a second net portion 6 connected to the first net portion 4 and formed with a second elastic net-shaped member 14; and a position holder 8 connected to the second net portion 6 and formed with an elastic belt-shaped member 16 including a friction surface 22. At wearing the wig foundation net 2, the first net portion 4, the second net portion 6 and the position holder 8 are located in the order thereof from a top side of the head, and
(Continued)

an elastic modulus of the second elastic net-shaped member 14 is higher than an elastic modulus of the first elastic net-shaped member 12.

7 Claims, 5 Drawing Sheets

(58) Field of Classification Search
USPC ..... 132/53, 54, 201; 2/174, 209.3, 171
See application file for complete search history.

(56) References Cited

U.S. PATENT DOCUMENTS

| | | | | |
|---|---|---|---|---|
| 3,561,455 | A | 2/1971 | Gregg | |
| 3,564,583 | A * | 2/1971 | Klugmann | A41G 3/00 132/53 |
| 2004/0168696 | A1* | 9/2004 | Cox | A41G 3/0041 132/54 |
| 2014/0202481 | A1* | 7/2014 | Sato | A41G 3/005 132/54 |
| 2018/0289092 | A1* | 10/2018 | Toba | A41G 3/005 |

FOREIGN PATENT DOCUMENTS

| | | | | |
|---|---|---|---|---|
| DE | 18 05 013 | | 8/1969 | |
| EP | 0349682 | A1 * | 1/1990 | A41G 3/0016 |
| JP | 55-4093 | | 1/1980 | |
| JP | 2000328336 | A * | 11/2000 | A41G 3/0016 |
| JP | 2002-371419 | | 12/2002 | |
| JP | 2002371419 | A * | 12/2002 | |
| JP | 2005-194653 | | 7/2005 | |
| JP | 2011-127228 | | 6/2011 | |
| JP | 2012-228323 | | 11/2012 | |
| JP | 2014-117308 | | 6/2014 | |
| JP | 2016037679 | A * | 3/2016 | A41G 3/00 |

OTHER PUBLICATIONS

International Search Report dated Sep. 6, 2016 in International (PCT) Application No. PCT/JP2016/072999.

* cited by examiner

WIG FOUNDATION NET

TECHNICAL FIELD

The present invention relates to a wig foundation net which collects and contains own hairs under a wig.

BACKGROUND ART

In order to prevent the own hairs from protruding from a wig and to prevent the wig from shifting at wearing the wig, a wig foundation net is used to collect and contain the own hairs under the wig. When the wig is used, hairs may be rejuvenated by the wig, but the wig may not improve sagging and wrinkles of the facial skin.

For example, a wig foundation net having a function of correcting the sagging and wrinkles of the facial skin has been proposed in order to cope with the improvement of the sagging and wrinkles of the facial skin (see Patent Document 1). Although it is not the wig foundation net, a turban that eliminates the sagging and wrinkles of the facial skin has also been proposed (see Patent Document 2).

BACKGROUND ART DOCUMENTS

Patent Documents

Patent Document 1: Japanese Patent Laid-open Publication No. 2014-117308

Patent Document 2: Japanese Patent Laid-open Publication No.

SUMMARY OF THE INVENTION

Problems to be Solved by the Invention

In the wig foundation net described in Patent Document 1, although the sagging and wrinkles of the face may be raised by a lift band applied to the top of the head, the wig foundation net and the wig mounted on the wig foundation net slide up due to force of the lift band applied to the top of the head.

In the turban described in Patent Document 2 including an upper layer portion, an intermediate layer portion and a lower layer portion, an elastic body having the maximum elastic modulus is used in the upper layer portion. Consequently, the turban slides up due to shrinkage of the upper layer portion in the top of the head.

An object of an aspect of the present invention is to solve the above mentioned problems, and to provide a wig foundation net that may surely correct the sagging and wrinkles on the facial skin as well as preventing the wig from sliding up.

Means for Solving the Problems

In order to solve the above mentioned problems, according to one aspect of the present invention, a wig foundation net worn under a wig, comprises: a first elastic net; a second elastic net connected to the first elastic net; and a position holder connected to the second elastic net and formed with an elastic belt including a friction surface. At wearing the wig foundation net, the first elastic net, the second elastic net and the position holder are located in the order thereof from a top side of the head, and an elastic modulus of the second elastic net is higher than an elastic modulus of the first elastic net.

Effects of the Invention

An aspect of the present invention may provide the wig foundation net which may surely correct the sagging and wrinkles on the facial skin as well as preventing the wig from sliding up.

DETAILED DESCRIPTION OF PREFERRED EMBODIMENTS

Figure 1:
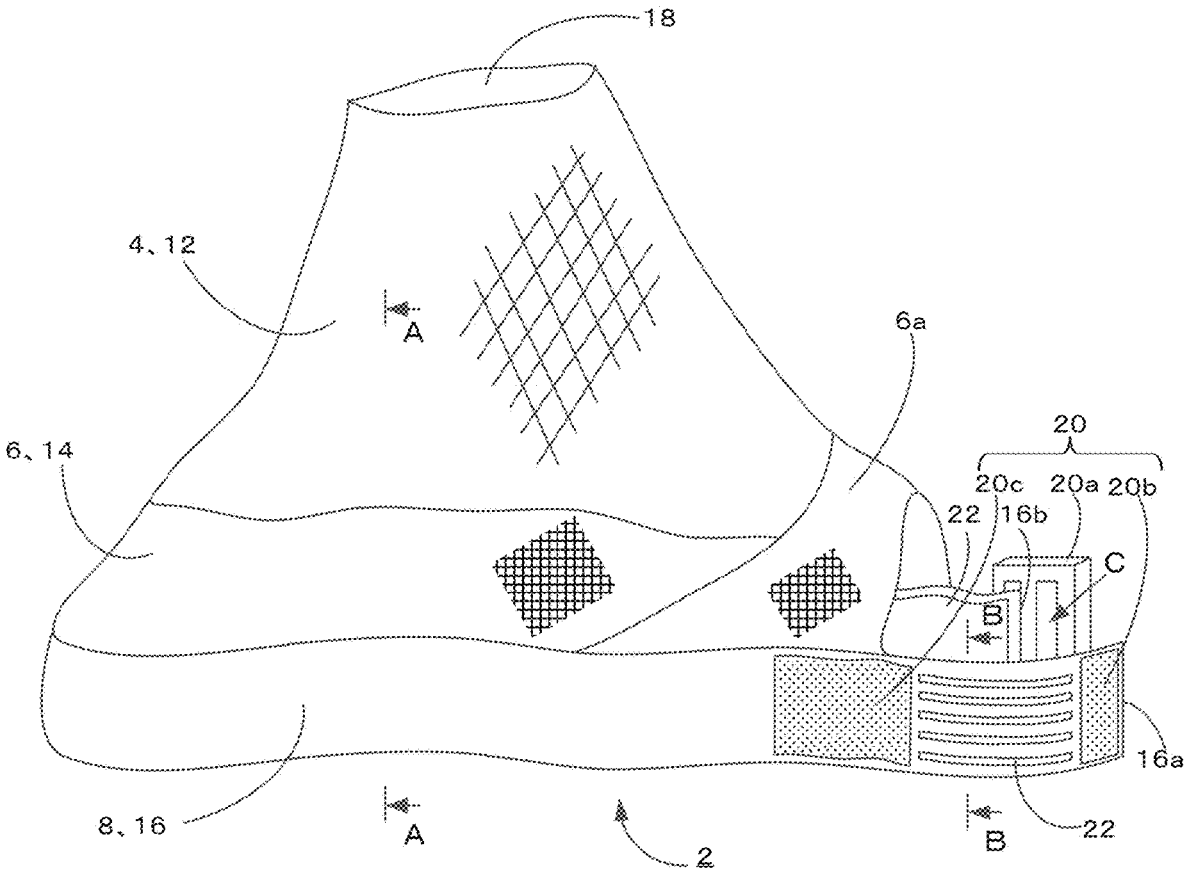
FIG. 1 is a schematic perspective view illustrating a structure of a wig foundation net according to one embodiment of the present invention.

According to a first aspect of the present invention, a wig foundation net worn under a wig comprises: a first net portion formed with a first elastic net-shaped member; a second net portion connected to the first net portion and formed with a second elastic net-shaped member; and a position holder connected to the second net portion and formed with an elastic belt-shaped member including a friction surface. At wearing the wig foundation net, the first net portion, the second net portion and the position holder are located in the order thereof from a top side of the head, and an elastic modulus of the second elastic net-shaped member is higher than an elastic modulus of the first elastic net-shaped member.

At this point, the "elastic net-shaped member" forming the first net portion and the second net portion is a sheet-shaped member in which elastic fibers are knitted in a net shape (or a lattice shape) or a resin material having elasticity is molded in a net shape (or a lattice shape), and the sheet-shaped member has a ventilation opening. Any size and shape of a mesh (lattice) may be used.

The "elastic belt-shaped member" forming the position holder is an elongated sheet-shaped member having elasticity, and the elastic belt-shaped member may be formed with a knitted item or woven item made of elastic fibers or a molded product made of an elastic resin material. As long as a predetermined elastic modulus may be obtained, not only the case that the fibers or resin material is closely packed, but also a net-shaped item having a vent opening may be used as the "elastic belt-shaped member".

In this aspect, during wearing the wig foundation net, the facial skin (for example, the skin in a vicinity of a temple in the vertical direction) may surely be held by the position holder including the friction surface. Additionally, since the elastic modulus of the second net portion (that is, the second elastic net-shaped member) is higher than the elastic modulus of the first net portion (that is, the first elastic net-shaped member), the wig foundation net may be prevented from sliding up, and at the same time, the facial skin held by the position holder may effectively be raised by the second net portion having the high elastic modulus, and thereby surely be correcting the sagging and wrinkles on the facial skin.

As described above, this aspect may provide the wig foundation net which has a face lifting up effect such that the sagging and wrinkles of the facial skin may surely be corrected as well as preventing the wig from sliding up.

In the wig foundation net according to a second aspect of the present invention, in the first aspect, the second net-shaped member is a fine net-shaped knitted item formed by Zokki knitting or interlacing knitting using elastic fibers.

Fibers such as polyurethane, polyester, nylon, acrylic, acetate and wool may be exemplified as the "elastic fiber", but the "elastic fiber" is not limited thereto. The "Zokki knitting" is a way of knitting with one kind of yarn and the "interlacing knitting" is a way of knitting by alternately combining two or more kinds of yarns. In this aspect, a known net-shaped knitted item used in female undergarments may be used.

In this aspect, since the second net member is the fine net-shaped knitted item by the Zokki knitting or the interlacing knitting using elastic fibers, the second net member has sufficient elasticity and is thin. Consequently, the second net member may be used while overlapped as described later.

In the wig foundation net according to a third aspect of the present invention, in the first or second aspect, a layer made of a rubber material or an elastomer material is formed on the friction surface of the position holder.

Silicone rubber, urethane rubber, vulcanized rubber may be exemplified as the rubber material or elastomer material used in this aspect, but the rubber material or the elastomer material is not limited thereto.

In this aspect, the layer made of the rubber material or the elastomer material is formed on the friction surface of the position holder, so that the facial skin may be securely held during wearing.

In the wig foundation net according to a fourth aspect the present invention, in any one of the first to third aspects, the first net portion includes an opening to pull out the own hairs.

In this aspect, since the first net portion includes the opening to pull out the own hairs, the amount of own hairs contained in the wig foundation net may be adjusted to a desired amount according to the amount and usage of the own hairs. Further, the first net portion also has the elasticity even though it is smaller than that of the second net portion. Therefore, the elastic force of the first net portion, and further the elastic force of the second net portion or the position holder may be adjusted by adjusting the amount of own hairs pulled out of the opening.

In the wig foundation net according to a fifth aspect of the present invention, it further comprises a latching member which may form the elastic belt-shaped member constituting the position holder into an annular shape, and adjust a length of the annular elastic belt-shaped member in the fourth aspect.

In this aspect, since a belt-shaped member is formed into the annular shape by the latching member, and the length of the belt-shaped member formed in the annular shape is adjusted by the latching member, the position holder may be adjusted to an optimum size according to the head of the user, and the facial skin may securely be held by the position holder during wearing.

In the wig foundation net according to a sixth aspect of the present invention, in the fifth aspect, the latching member may hold the own hairs pulled out of the opening at wearing the wig foundation net.

For example, in the case that the amount of the own hairs is large, during wearing, the first net portion which contains the own hairs or the own hairs pulled out of the opening of the first net portion may not completely be help by a pin, but move(s) upwards, and there is a possibility that the worn wig may slide up. In this aspect, since the own hairs which are pulled out may be kept by the latching member, the own hairs which are pulled out may be prevented from moving and the wig mounted on the own hairs may be prevented from sliding up.

In the wig foundation net according to a seventh aspect of the present invention, in any one of the first to sixth aspects, the second net-shaped member is overlapped in the region corresponding to a back side of the head in the second net portion.

In this aspect, since the second net-shaped member is overlapped in a region corresponding to the back side of the head in the second net portion, the second net-shaped member has further stronger elasticity. The elastic force is applied not only in the upward direction but also in the backward direction by the second net portion, so that the force may be dispersed. Accordingly, a pulling force dispersing the sagging of the pulled skin backward is generated as well as the wig foundation net is prevented from sliding up, whereby a further face-up effect may be obtained.

In the wig foundation net according to an eighth aspect of the present invention, in any one of the first to seventh aspects, an elastic modulus of the elastic belt-shaped member is higher than an elastic modulus of the second elastic net-shaped member.

In this aspect, the elastic modulus of the elastic belt-shaped member of the position holder located at the lowest side of the head during wearing in the wig foundation net is higher than the elastic modulus of the second elastic net-shaped member (as described above, the elastic modulus of the second elastic net-shaped member is higher than the elastic modulus of the first elastic net-shaped member). Accordingly, the facial skin may surely be held, and the sagging and wrinkles of the facial skin may surely be corrected using the elastic force of the second net portion.

The wig foundation net according to the aspects of the present invention will be described in detail below with reference to the drawings.

(Structure of Wig Foundation Net)

Figure 2:
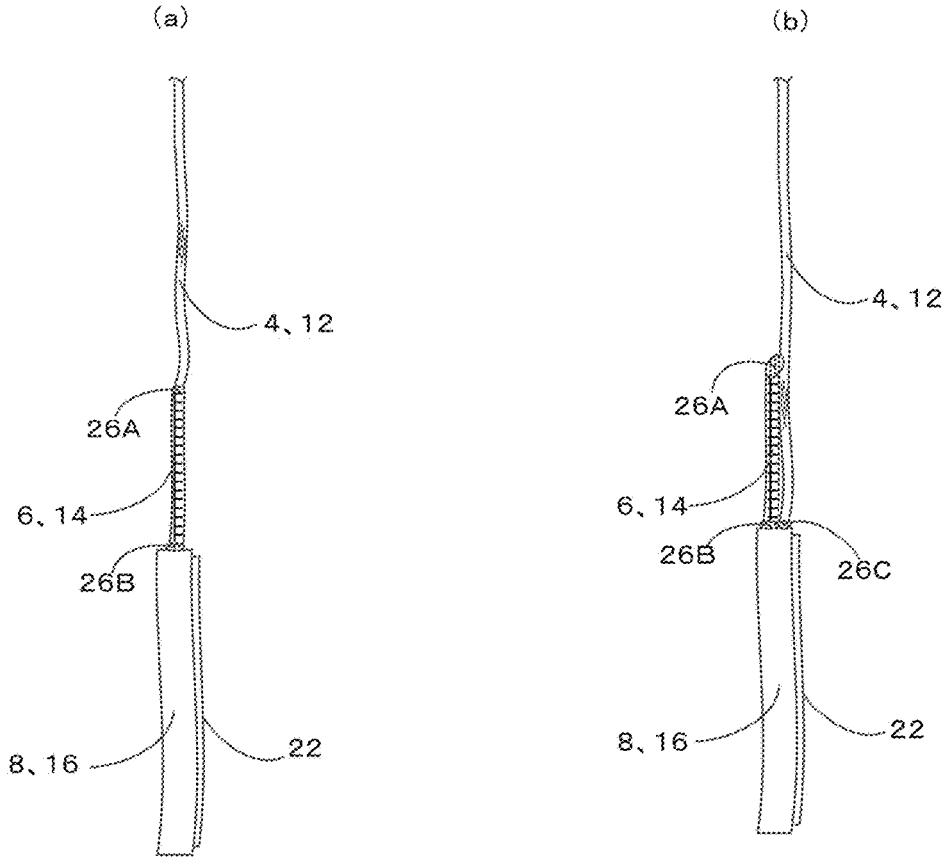
FIG. 2 is a view illustrating a section A-A in FIG. 1, and is a sectional view illustrating an embodiment of a connection between a first net portion and a second net portion.
Figure 3:
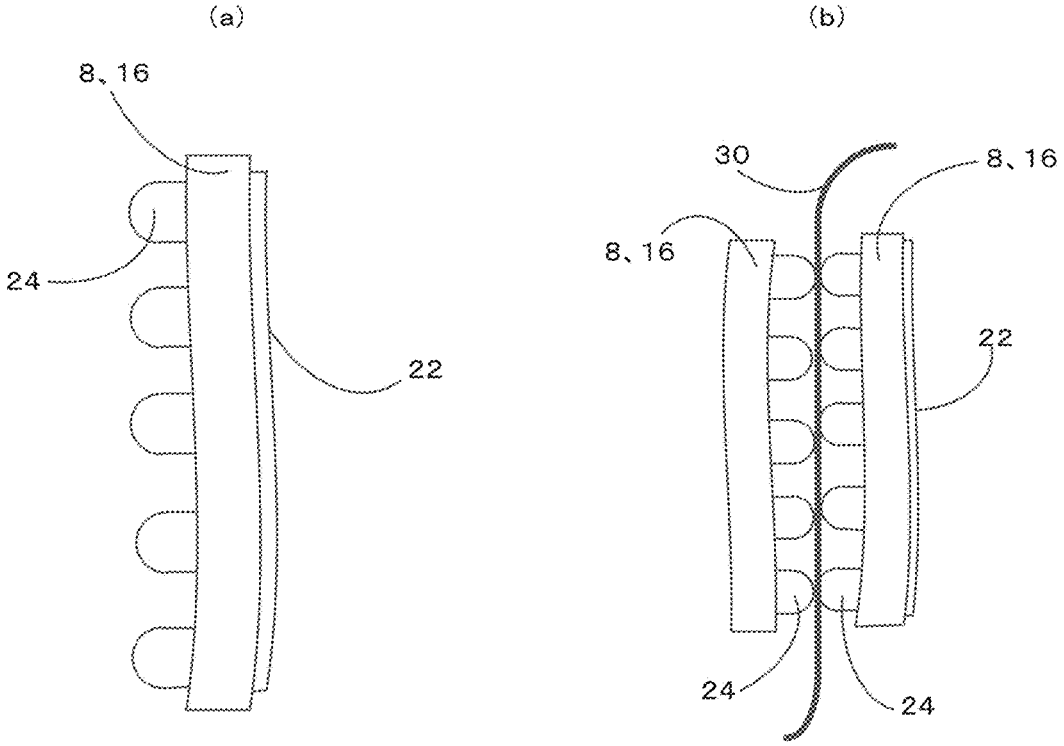
FIG. 3 is a view illustrating a section B-B in FIG. 1, and is a sectional view illustrating an embodiment relating to a latching member of a position holder.

A structure of a wig foundation net according to one embodiment of the present invention will be described with reference to FIGS. 1 to 3. FIG. 1 is a schematic perspective view illustrating a structure of a wig foundation net according to one embodiment of the present invention, FIG. 2 is a view illustrating a section A-A in FIG. 1, and is a sectional view illustrating an embodiment of a connection between a first net portion and a second net portion, and FIG. 3 is a view illustrating a section B-B in FIG. 1, and is a sectional view illustrating an embodiment relating to a latching member of a position holder.

A wig foundation net 2 is a net-shape member, which is worn under the wig to collect and contain the own hairs under the wig. Details of usage will be described in detail later with reference to FIG. 5.

In FIG. 1, the wig foundation net 2 includes a first net portion 4 formed with a first elastic net-shaped member 12, a second net portion 6 which is connected to the first net portion 4 and formed with a second elastic net-shaped member 14, and a position holder 8 which is connected to the second net portion 6 and formed with an elastic belt-shaped member 16 having a friction surface 22. During wearing, the first net portion 4, the second net portion 6 and the position holder 8 are located in the order thereof from a top side of the head (for example, refer to FIG. 5(*a*)), and force is transmitted between the upper-side first net portion 4 and the lower-side position holder 8 via the second net portion 6 located therebetween. The following description will be made using a position (for example, an upper side and a lower side) during wearing the wig foundation net.

The first net portion 4 has a tubular shape in which the upper side is slightly narrowed and an opening 18 through which the own hairs may be drawn out onto the upper side. Consequently, in wearing the wig foundation net 2, the wig foundation net 2 may easily be worn by taking out a part of the own hairs from the opening 18, and an amount of own hairs contained in the wig foundation net 2 may be adjusted. The second net portion 6 located at the lower side of the first net portion 4 is formed into a substantially annular shape, and the second elastic net-shaped member 14 is overlapped in a region 6*a* corresponding to the back side of the head.

The position holder 8 is mainly formed with the elastic belt-shaped member 16, and the elastic belt-shaped member 16 has an annular shape, and includes a latching member 20 which may adjust a length of the annular elastic belt-shaped member 16.

A sheet-shaped member including ventilation openings in which elastic fibers are woven in a net shape (or lattice shape) is used as the first elastic net-shaped member 12 and the second elastic net-shaped member 14. The second elastic net-shaped member 14 has a finer mesh, and an elastic modulus of the second elastic net-shaped member 14 is higher than an elastic modulus of the first elastic net-shaped member 12. In particular, the second elastic net-shaped member 14 is formed with a fine net-shaped knitted item by Zokki knitting or interlacing knitting using elastic fibers.

Accordingly, the first net portion 4 may be referred to as a weak pressure portion, and the second net portion 6 may be referred to as a strong pressure portion.

Fibers such as polyurethane, polyester, nylon, acrylic, acetate and wool may be exemplified as the elastic fiber, but the elastic fiber is not limited thereto. The "Zokki knitting" is a way of knitting with one kind of yarn and the "interlacing knitting" is a way of knitting by alternately combining two or more kinds of yarns. In the present embodiment, a known net-shaped knitted item used in female undergarments may be used.

In the present embodiment, since the second net member 6 is the fine net-shaped knitted item by the Zokki knitting or the interlacing knitting using elastic fibers, the second net member 6 has sufficient elasticity and is thin. Consequently, as described above, the second net member 6 may easily be overlapped in the region 6*a* corresponding to the side of the back of the head.

Not only the elastic fibers woven into the net shape (or a lattice shape), but also a sheet-shaped member having a vent opening, in which elastic resin materials (including rubber and elastomer) is molded into the net shape (or the lattice shape), may also be used in the first elastic net-shaped member 12 and the second elastic net-shaped member 14.

The elastic belt-shaped member 16 constituting the position holder 8 is an elongated sheet-shaped member having elasticity. In the present embodiment, the elastic belt-shaped member 16 is a knitted item or a woven item made of elastic fibers such as polyurethane, polyester and nylon. However, the elastic belt-shaped member 16 is not limited to the knitted item or woven item made of elastic fibers such as polyurethane, polyester and nylon, but may be a molded article made of an elastic resin material (including rubber and elastomer) having elasticity. As long as a predetermined elastic modulus may be obtained, not only the case that the fibers or resin material is closely packed, but also a net-shaped item having a vent opening may be used as the elastic belt-shaped member 16.

In the present embodiment, the elastic modulus of the elastic belt-shaped member 16 constituting the position holder 8 is higher than the elastic modulus of the second elastic net-shaped member 14 constituting the second net portion 6. That is, the position holder 8 has the highest elastic modulus among the first net portion 4, the second net portion 6 and the position holder 8 constituting the wig foundation net 2.

The friction surface 22 is provided on a surface which is in contact with the head during wearing of the position holder 8. In the present embodiment, the friction surface 22 is formed by providing a silicone rubber layer on the surface of the elastic belt-shaped member 16. However, it is not limited thereto. For example, a layer made of a rubber material or an elastomer material such as urethane rubber and vulcanized rubber is provided on the surface of the elastic belt-shaped member 16, whereby the friction surface 22 may be formed. These layers may be provided on the surface of the elastic belt-shaped member 16 by coating, or provided by bonding a tape including a silicone rubber layer to the surface of the elastic belt-shaped member 16. Alternatively, the elastic belt-shaped member 16 is formed into an uneven surface, which allows the friction surface 22 to be provided.

In the present embodiment, since the layer made of the rubber material or the elastomer material is formed on the friction surface 22 of the position holder 8, the facial skin may be securely held during wearing.

An embodiment of the connection of the first net portion 4 and the second net portion 6 will be described below with reference to FIG. 2 illustrating a section A-A in FIG. 1. As illustrated in FIGS. 2(*a*) and 2(*b*), the second net portion 6 is connected to the first net portion 4 by a connecting portion 26A, and the position holder 8 having the friction surface 22 is connected to the second net portion 6 by a connecting portion 26B. The force is transmitted between the upper-side first net portion 4 and the lower-side position holder 8 via the second net portion 6 located therebetween. In particular, the facial skin held by the position holder 8 may be effectively raised by elastic force of the second net portion 6 connected to the position holder 8 by the connecting portion 26B.

In the embodiment of FIG. 2(*b*), the first net portion 4 extends downward below the connecting portion 26A with the second net portion 6, and the portion extending to the lower side is disposed along the second net portion 6. One end portion of the first net portion 4 extending to the lower side is connected to the position holder 8 by a connecting portion 26C. The first net portion 4 also generates elastic force although the elastic force is smaller than the elastic force of the second net portion 6. Consequently, in the embodiment of FIG. 2(*b*), the elastic force of the first net portion 4 between the connecting portion 26A and the connecting portion 26C also exerts the function of raising the facial skin held by the position holder 8 in conjunction with the second net portion 6.

As to the connecting portions 26A to 26C, the connection may be performed by sewing, an adhesive agent, or a connecting member.

The latching member 20 included in the position holder 8 will be described in detail below with reference to FIG. 1. In the latching member 20, the elastic belt-shaped member 16 may be formed into an annular shape, and the length of the annular elastic belt-shaped member 16 may be adjusted.

The latching member 20 of the present embodiment includes a clasp 20*a* having two openings, a first Hook-and-Loop fastener 20*b* provided at one end 16*a* of one surface of the elastic belt-shaped member 16, and a second Hook-and-Loop fastener 20*c* that is provided on one surface of the elastic belt-shaped member 16 while separated from the first Hook-and-Loop fastener 20*b* by a predetermined distance. Another end 16*b* located at an opposite side to the end 16*a* at which the first Hook-and-Loop fastener 20*b* of the elastic belt-shaped member 16 is inserted in one opening of the clasp 20*a*, and the clasp 20*a* is fixed to the end 16*b* of the elastic belt-shaped member 16.

In wearing the wig foundation net 2, the end 16*a* at which the first Hook-and-Loop fastener 20*b* of the elastic belt-shaped member 16 is provided is inserted in the other opening of the clasp 20*a* indicated by an arrow C, and then, the elastic belt-shaped member 16 may be folded back outward to press the first Hook-and-Loop fastener 20*b* against the second Hook-and-Loop fastener 20*c*, and thereby engaging the first Hook-and-Loop fastener 20*b* and the second Hook-and-Loop fastener 20*c*. Consequently, the elastic belt-shaped member 16 is formed into the annular shape, and may be worn on the head of a user.

At this moment, since the predetermined distance exists between the first Hook-and-Loop fastener 20*b* and the second Hook-and-Loop fastener 20*c*, and the second Hook-and-Loop fastener 20*c* has a predetermined length, the length of the annular elastic belt-shaped member 16 may be adjusted. The elastic belt-shaped member 16 has elasticity, so that the user may adjust the length of the elastic belt-shaped member 16 to the length in which the facial skin may securely be fixed without having an unpleasant feeling.

One of the first Hook-and-Loop fastener 20*b* and the second Hook-and-Loop fastener 20*c* is raised into a hook shape, and the other is raised densely in a loop shape, and the first Hook-and-Loop fastener 20*b* and the second Hook-and-Loop fastener 20*c* are connected by pressing the first Hook-and-Loop fastener 20*b* and the second Hook-and-Loop fastener 20*c* against each other. Consequently, the first Hook-and-Loop fastener 20*b* and the second Hook-and-Loop fastener 20*c* may freely be connected and released. However, the present invention is not limited thereto. For example, it is possible to use the first Hook-and-Loop fastener 20*b* and the second. Hook-and-Loop fastener 20*c* as both the hooks and the loops are implanted, as raised in a mushroom shape, and as formed in saw-tooth shape.

Any other latching means except for the face tape may be used as the latching member 20. For example, a plurality of snaps may be provided, adjustable engagement means having a plurality of ratchets may be used, or latching means for engaging both openings of a clasp similar to the clasp 20*a* through the elastic belt-shaped member 16 with friction force may be used.

In the present embodiment, the elastic belt-shaped member 16 constituting the position holder 8 is formed into the annular shape by the latching member 20, and the length of the elastic belt-shaped member 16 is adjusted by the latching member 20. Consequently, the position holder 8 may be adjusted to an optimum size according to the head of the user, and the facial skin may securely be held by the position holder 8 during wearing.

For example, in the case that, the amount of the own hairs is large, during wearing, the first net portion which contains the own hairs or the own hairs pulled out of the opening 18 of the first net portion 4 may not completely be held by a pin, but moves upwards, and there is a possibility that the worn wig may slide up. However, in the present embodiment, since the own hairs which are pulled out may be kept by the latching member 20, the own hairs which are pulled out may be prevented from moving and the wig mounted thereon may be prevented from sliding up.

The latching member 20 of the position holder 8 will further be described below with reference to FIG. 3(*a*) illustrating a section B-B in FIG. 1. As described above, the predetermined distance exists between the first Hook-and-Loop fastener 20*b* and the second Hook-and-Loop fastener 20*c* of the latching member 20, and a plurality of protrusions 24 made of silicone rubber are provided in the portion of the predetermined distance.

In wearing the wig foundation net 2, the elastic belt-shaped member 16 is inserted in the other opening of the clasp 20*a*, and then folded back so that the first Hook-and-Loop fastener 20*b* and the second hook fastener 20*c* are engaged. At this moment, as illustrated in FIG. 3(*b*), the protrusions 24 provided in the folded-back elastic belt-shaped member 16 abut on each other.

As described above, by keeping the own hairs pulled out of the opening 18 of the first net portion 4 using the latching member 20, the pulled-out own hairs may be prevented from moving, and the wig mounted on the own hair be prevented from sliding up. At this moment, as illustrated in FIG. 3(*b*), the own hair which are pulled-out may more surely be held by sandwiching the own hairs between the plurality of protrusions 24 made of silicone rubber having a high friction coefficient and elasticity. Accordingly, the worn wig may be prevented more surely from sliding up, (Usage Condition of Wig Foundation Net)

Figure 4:
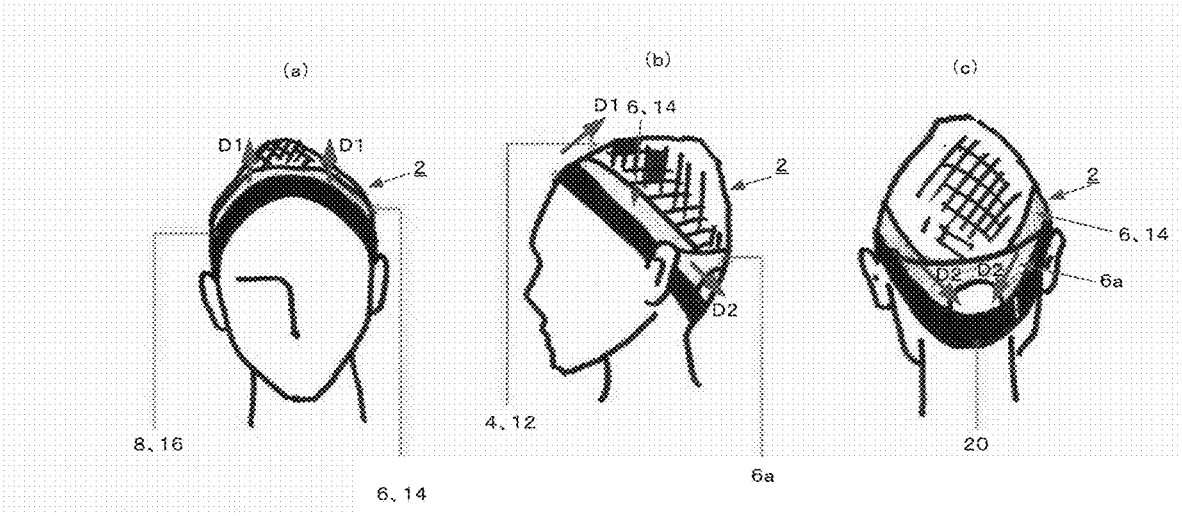
FIG. 4 is a schematic diagram illustrating a mode in which a user wears the wig foundation net according to one embodiment of the present invention.

The case that the wig foundation net 2 in FIG. 1 is worn will be described below with reference to FIG. 4. FIG. 4(*a*) illustrates a front side of the user who wears the wig foundation net 2, FIG. 4(*b*) illustrates a lateral side, and FIG. 4(*c*) illustrates a back side. During wearing the wig foundation net, the first net portion 4, the second net portion 6 and the position holder 8 are located in the order thereof from the top side of the head, and the force is transmitted between the upper-side first net portion 4 and the lower-side position holder 8 via the second net portion 6 located therebetween. The first net portion 4 is located on the upper side of the head, and the second net portion 6 and the position holder 8 are located below the first net portion 4.

The position holder 8 has the highest elastic modulus among the first net portion 4, the second net portion 6 and the position holder 8, and surely holds the facial skin. That is, the position holder 8 has a large non-slip function to hold the face line. The second net portion 6 has the elastic modulus higher than the first net portion 4, and the second elastic net-shaped member 14 constituting the second net portion 6 has the high elastic modulus as a net-shaped member. Accordingly, by elastic force D1 of the second net portion 6 indicated by arrows in FIGS. 4(*a*) and 4(*b*), the face line held by the position holder 8, in particular, outer corners of eyes, cheeks may be raised, and thereby correcting wrinkles and sagging of the skin.

On the other hand, the first net portion 4 has the low elastic modulus, that is, the first net portion 4 stretches largely. Consequently, even in long hairs, the first net portion 4 may confine the own hairs properly and contain the own hairs in the wig.

The elastic modulus of the second net portion 6 and the position holder 8, which are located on the lower side of the head, are higher than the elastic modulus of the first net portion 4 located on the upper side of the head, so that the sagging and wrinkles facial skin may be corrected without fail as well as the wig foundation net 2 is prevented from sliding up. This point will be described in detail with reference to FIG. 6.

(Relationship between Positions of First Net Portion 4. Position of Second Net Portion 6 & the Position Holder 8 and Elastic Modulus)

Figure 6:
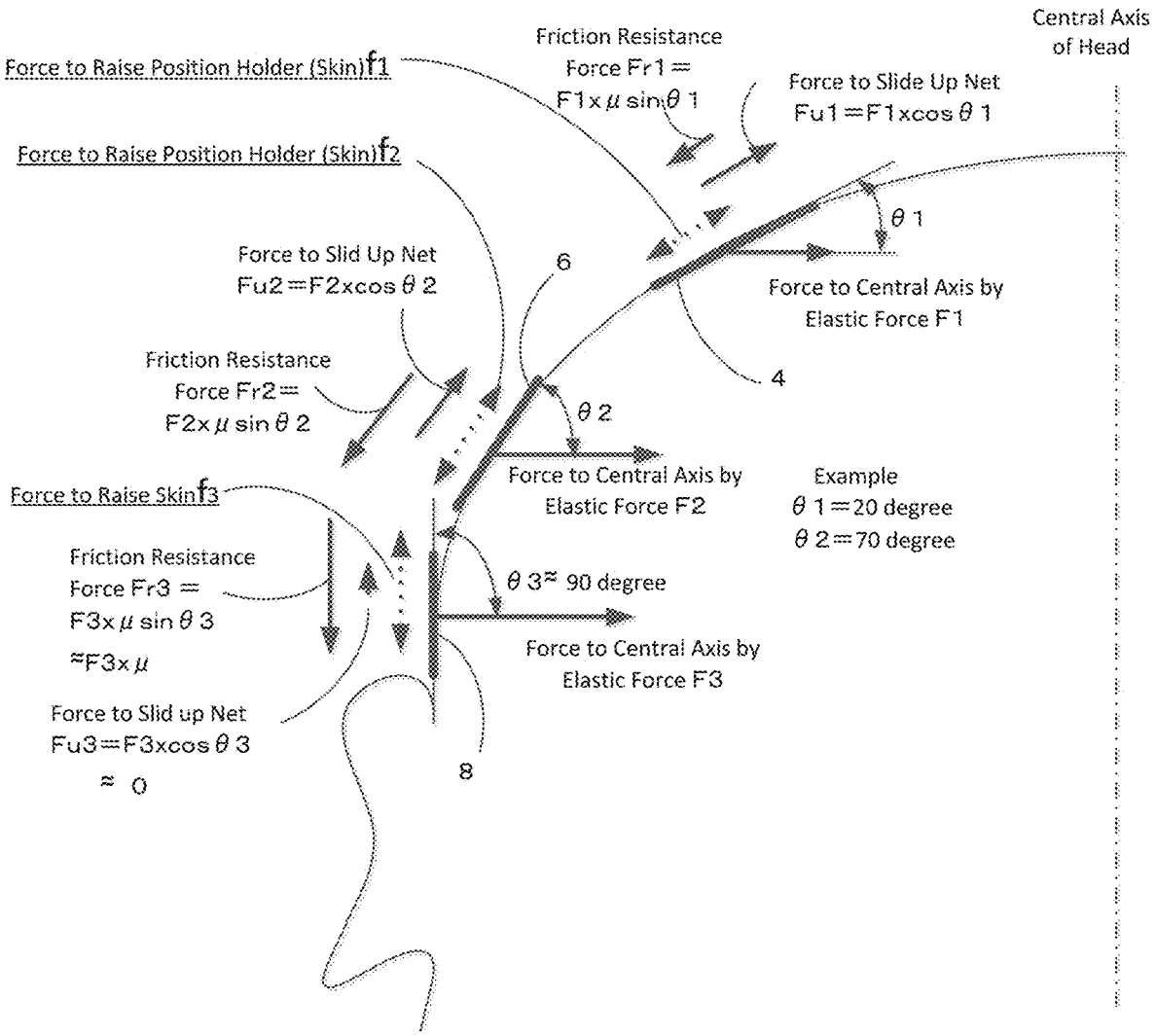
FIG. 6 is a schematic diagram illustrating the case that the wig foundation net of the present invention has a function of preventing the wig from sliding up as well as raising the facial skin.

FIG. 6 is a schematic diagram illustrating the case that the wig foundation net 2 has the function of preventing the wig from sliding up and of raising facial skin, and FIG. 6 schematically illustrates a left half (or a right half) of the face. At this moment, a central axis of the head is vertical, and a direction orthogonal to the central axis of the head corresponds to a direction of a horizontal line.

Since the first net portion 4, the second net portion 6 and the position holder 8 have the elasticity, in wearing the wig foundation net 2, the elastic force is applied in a circumferential direction of the head (the direction perpendicular to the paper plane of FIG. 6) and a vertical direction along the contour of the head orthogonal to the circumferential direction (the elastic force fi (i=1, 2, 3) indicated by the dotted arrows in FIG. 6). Horizontal force Fi (i=1, 2, 3) toward the central axis of the head is applied at each of the positions of the first net portion 4, the second net portion 6 and the position holder 8 by the elastic force in a shrinking direction of the circumferential direction of the head.

In FIG. 6, the first net portion 4 is located on the upper side of the head, and the first net portion 4 has a very small angle (elevation angle) θ1 with respect to the horizontal line. That is, an inclination of the first net portion 4 is close to the horizontal line.

The second net portion 6 is located on the lower side of the head, and an angle (elevation angle) θ2 of the second net portion 6 with respect to the horizontal line is considerably larger than the angle (elevation angle) θ1 of the first net portion 4.

The position holder 8 is located on the further lower side of the head, that is, at the temporal region of head, and an angle (elevation angle) θ3 of the position holder 8 with respect to the horizontal line is approximately 90 degrees. That is, the inclination of the position holder 8 is substantially vertical.

In the case that the first net portion 4, the second net portion 6 and the position holder 8 have an angle (elevation angle) θi (i=1, 2, 3) with respect to the horizontal line, as a component force of the horizontal force Fi in the head center direction, Fi×cos θi is applied in a tangentially upward direction of the head, and Fi×sin θi is applied in a head inside direction that is the vertical direction of the tangent. At this moment, assuming that μ is a friction coefficient between the first net portion 4, the second net portion 6 & the position holder 8 and the head, Fi×μ sin θi is applied in a tangential downward direction as a frictional resistance force. That is, the force is applied such that the wig foundation net 2 slides up by the force Fi×cos θi applied in the tangential upward direction, whereas the force is applied such that the wig foundation net 2 is prevented from sliding up by the frictional resistance force Fi×μ sin θi.

When the angle θi is small, that is, when θi is close to 0 at a position on the upper side of the head, the value of Fi×cos θi that is the force causing the wig foundation net 2 to slide up is large and the value of Fi×μ sin θi that is the frictional resistance force preventing the wig foundation net 2 from sliding up is small. On the other hand, as the value of the angle θi increases, the value of Fi×cos θi that is the force causing the wig foundation net 2 to slide up decreases, and the value of Fi×μ sin θi that is the frictional resistance force preventing the wig foundation net 2 from sliding up increases. In other words, as the wig foundation net 2 moves to the position on the lower side of the head, the force causing the wig foundation net 2 to slide up becomes smaller, and the force preventing the wig foundation net 2 from sliding up becomes larger.

In the first net portion 4, in the case that the force F1 is applied in the direction of the center axis of the head by the elastic force, the force causing the wig foundation net 2 to slide up becomes Fu1=F1×cos θ1, and the friction resistance force preventing the wig foundation net 2 from sliding up becomes Fr1=F1×μ sin θ1.

In the second net portion 6, in the case that the force F2 is applied in the head center direction by the elastic force, the force causing the wig foundation net 2 to slide up becomes Fu1=F2×cos θ2, and the friction resistance force preventing the wig foundation net 2 from sliding up becomes Fr2=F2×μ sin θ2.

In the position holder 8, in the case that the force F3 is applied in the head center direction by the elastic force, the force causing the wig foundation net 2 to slide up becomes Fu3=F3×cos θ3, and the friction resistance force preventing the wig foundation net 2 from sliding up becomes Fr3=F3×μ sin θ3.

In the position holder 8, the force Fu3 causing the wig foundation net 2 to slide up is Fu3=F3× cos θ3, and Fu3≈0 because of θ3√90 degrees. On the other hand, the frictional resistance force Fr3 preventing the wig foundation net 2 from sliding up is Fr3=F3×μ sin θ3, and Fr3≈F3×μ because of θ3√90 degrees.

As an example, assuming that the angle (elevation angle) θ1 of the first net portion 4 with respect, to the horizontal direction is 20 degrees, that the angle (elevation angle) θ2 of the second net portion 6 with respect to the horizontal direction is 70 degrees, and that the friction coefficient is 0.45, the force causing the wig foundation net 2 to slide up and the force preventing the wig foundation net 2 from sliding up are as follows.

<First Net Portion 4>

Force causing the wig foundation net 2 to slide up: Fu1=F1× cos 20°=0.94F1

Friction resistance force preventing the wig foundation net 2 from sliding up:

$$=F1\times 0.45\times \sin 20°=0.15F1.$$

That is, Fu1>Fr1.

<Second Net Portion 6>

Force causing the wig foundation net 2 to slide up: Fu2=F2× cos 70°=0.34F2

Friction resistance force preventing the wig foundation net 2 from sliding ups $$Fr2=F2\times 0.45\times \sin 70°=0.42F2.$$

That is, Fu1<Fr2.

Consequently, there is a high possibility that the wig foundation net 2 slides up in the first net portion 4, whereas there is a high possibility that the position of the wig foundation net 2 is held in the second net portion 6. The frictional resistance force Fr2 also acts as holding force against the sliding-up force generated in the first net portion 4. As described above, in the position holder 8, the sliding-up force is hardly applied, and the frictional resistance force $Fr3 \approx 0.45F3$ is applied as the holding force against the sliding-up force generated in the first net portion 4.

For example, in the case that a rubber band is applied to a conical inclined surface while the inclined surface is nearly vertical, the position of the rubber band is held. However, as the inclined surface becomes close to horizontal, the position of the rubber band may not be held, and the rubber band moves upward. Consequently, a difference in position between the first net portion 4 and the second net portion 6 may be felt even from the above event.

When the elastic force of the first net portion 4 is larger than the elastic force of the second net portion 6 or the position holder 8, that is, when F1 is larger than F2 or F3, there is a risk that the wig foundation net 2 slides up by the sliding-up force generated in the first net portion 4. For example, in the case of $0.94F1+0.17F2>0.15F1+0.44F2+F3$ ($F1>0.34F2+127F3$), there is a risk that the wig foundation net 2 slides up.

However, in the present embodiment, the elastic modulus of the second elastic net-shaped member 14 of the second net portion 6 is higher than the elastic modulus of the first elastic net-shaped member 12 of the first net portion 4, so that the wig foundation net 2 may effectively be prevented from sliding up. Additionally, the elastic modulus of the elastic belt-shaped member 16 of the position holder 8 is higher than the elastic modulus of the second elastic net-shaped member 14 of the second net portion 6, so that the wig foundation net 2 may more effectively be prevented from sliding up.

On the other hand, as to the elastic force in the vertical direction along the contour of the head, as indicated by the dotted arrow in FIG. 6, f1 is applied in the first net portion 4, f2 is applied in the second net portion 6, and f3 is applied in the position holder 8, which contributes to the raising of the facial skin held by the position holder 8. In particular, the facial skin held by the position holder 8 may effectively be raised by the elastic force 12 of the second net portion 6. The elastic force f3 of the position holder 8 also has a function of raising the facial skin in a range of a height dimension (a width dimension of the elastic belt-shaped member 16) of the position holder 8.

Although f1 of the first net portion 4 is smaller than the elastic force f2 of the second net portion 6, f1 has a function of raising the facial skin. In particular, since the amount of the own hairs contained in the wig foundation net 2 may be adjusted using the opening 18 provided in the first net portion 4, the elastic force in the first net portion 4 may be adjusted, and thereby adjusting the elastic force in the second net portion 6 and position holder 8 which are connected together.

As described above, in the present embodiment, during wearing, the facial skin (for example, the skin in a vicinity of a temple in the vertical direction) may surely be held by the position holder 8 including the friction surface 22. Additionally, since the elastic modulus of the second net portion. 6 (that is, the second elastic net-shaped member 14) is higher than the elastic modulus of the first net portion 4 (that is, the first elastic net-shaped member 12), the wig foundation net 2 may be prevented from sliding up, the facial skin held by the position holder 8 may effectively be raised by the second net portion 6 having the high elastic modulus, and thereby surely correcting the sagging and wrinkles on the facial skin.

As described above, the present embodiment may provide the wig foundation net 2 which has a face lifting up effect such that the sagging and wrinkles of the facial skin may be surely corrected as well as preventing the wig from sliding up.

In the present embodiment, the elastic modulus of the elastic belt-shaped member 16 of the position holder 8 located at the lowest side of the head in the wig foundation net 2 during wearing is higher than the elastic modulus of the second elastic net-shaped member 14 of the second net portion 6 (the elastic modulus of the second elastic net-shaped member 14 is higher than the elastic modulus of the first elastic net-shaped member 12). Accordingly, the facial skin may surely be held, and the sagging and wrinkles of the facial skin may surely be corrected using the elastic force of the second net portion 6.

As described above, in the present embodiment, since the first net portion 4 includes the opening 18 to pull out the own hairs, the amount of own hair contained in the wig foundation net 2 may be adjusted to a desired amount according to the amount and usage of the own hairs. Further, the first net portion 4 also has the elasticity smaller than that of the second net portion 6, so that the elastic force of the first net portion 4 may be adjusted by adjusting the amount of own hairs pulled out of the opening 18, and thereby also adjusting the elastic force of the second net portion 6 or the position holder 8.

As illustrated in FIGS. 4(*b*) and 4(*c*), in the present embodiment, since the second net-shaped members 14 are overlapped in the region corresponding to the back side of the head in the second net portion 6 as indicated by reference numeral 6*a*, the overlapped second net-shaped member 14 will have larger elasticity. In addition to the upward elastic force D1, elastic force D2 (see FIGS. 4(*b*) and 4(*c*)) is applied in a backward direction by the second net portion 6, so that, the force may be dispersed. Accordingly, a pulling force dispersing the sagging of the pulled skin backward is generated as well as the wig foundation net 2 is prevented from sliding up, whereby a further face-up effect may be obtained.

(Method for Wearing Wig Foundation Net)

Figure 5:
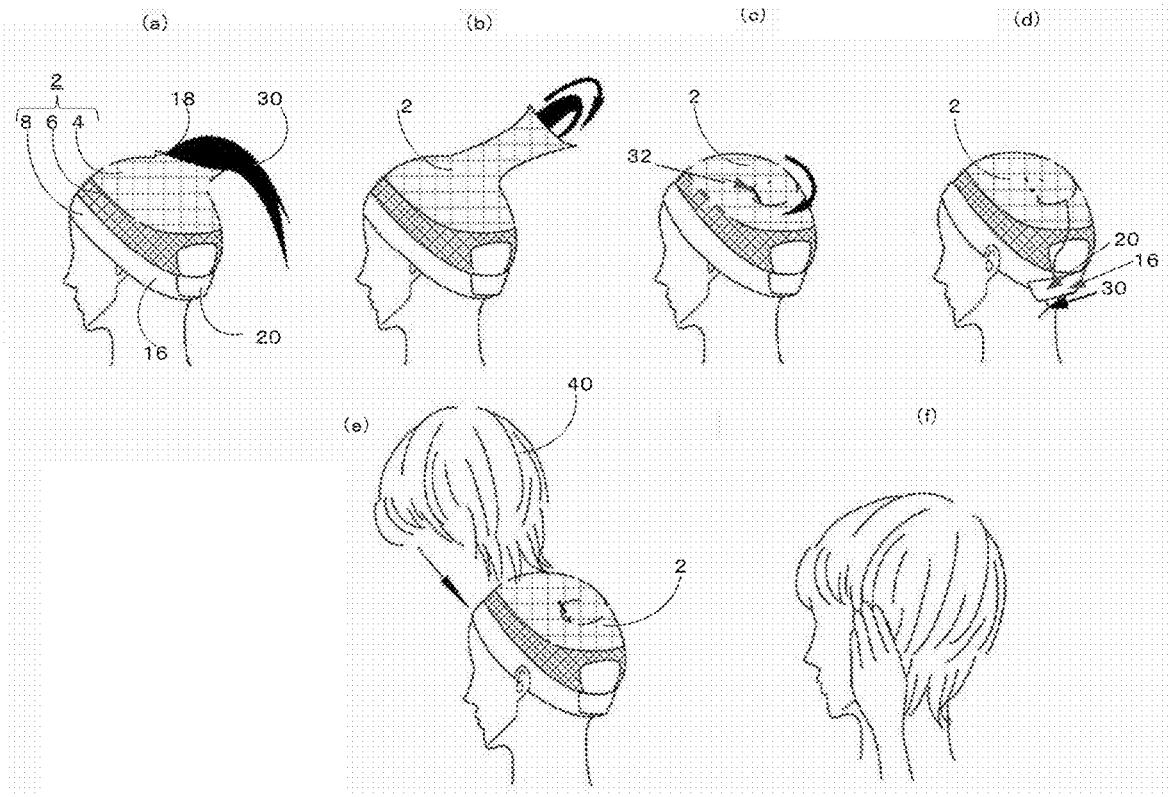
FIG. 5 is a schematic diagram illustrating a method of wearing the wig foundation net according to one embodiment of the present invention.

A method for wearing the wig foundation net 2 in FIG. 1 will be described below with reference to FIG. 5. As illustrated in FIG. 5(*a*), a user adjusts the length of the elastic belt-shaped member 16 using the latching member 20 and wears the wig foundation net 2. At this moment, in the case of long own hairs, the wig foundation net 2 may easily be worn by pulling out the own hairs from the opening 18 of the first net portion 4. Then, as illustrated in FIG. 5(*b*), the user pulls up the first net portion 4 to contain the own hairs in the first net portion 4. Then, as illustrated in FIG. 5(*c*), the user collects the ends of the first net portion 4 and fastens it with a pin 32. Then, as illustrated in FIG. 5(*d*), the user readjusts the length of the elastic belt-shaped member 16 using the latching member 20, and brings the ears outward. The own hairs pulled out of the opening 18 of the first net portion 4 may also be fastened with the pin 32.

At this moment, in the case that the amount of the own hairs is large, during wearing, the first net portion 4 which contains the own hairs or the own hairs pulled out of the opening 18 of the first net portion 4 may not completely be held by the pin 32, but moves upwards, and there is a possibility that the worn wig may slide up. For this reason, as illustrated in FIG. 5(*d*), since the pulled-out own hairs may be held by the latching member 20, the own hairs which are pulled out may be prevented from moving and the wig mounted on the own hair may be prevented from sliding up.

Then, a wig 40 is mounted on the wig foundation net 2 worn by the user as illustrated in FIG. 5(*e*), and the wig foundation net 2 and the wig 40 are positioned as illustrated in FIG. 5(*f*). At this moment, the wig foundation net 2 and the wig 40 may be fixed using an adhesive tape or an engagement member such as a pin.

As described above, the face-up effect that corrects the sagging and wrinkles of the facial skin as well as preventing the wig 40 from sliding up may be obtained using the wig foundation net 2 of the embodiment of the present embodiment.

Although the embodiment of the present invention has been described above, the disclosed content may be changed in details of the composition, and combinations of elements, changes in order may be provided in the embodiment without departing from the scope and spirit of the invention.

DESCRIPTION OF REFERENCE SIGNS

2: Wig foundation net
4: First net portion
6: Second net portion
6*a*: Double part of second net portion
8: Position holder
12: First elastic net-shaped member
14: Second elastic net-shaped member
16: Elastic belt-shaped member
18: Opening
20: Latching member
22: Friction surface
24: Protrusion
30: Own hair
32: Pin
40: Wig

The invention claimed is:

1. A wig foundation net configured to be worn under a wig, comprising:

a first elastic net, the first elastic net having a tubular shape;

a second elastic net, the second elastic net having an annular shape; and an elastic belt for holding a position of the wig foundation net on a head of a user;

wherein each of the first elastic net, the second elastic net and the elastic belt has a top edge, a bottom edge, an anterior portion having opposing first and second ends, and a posterior portion having opposing first and second ends, the first ends of the anterior and posterior portions are immediately adjacent one another and form a continuous structure, and the second ends of the anterior and posterior portions are immediately adjacent one another and form a continuous structure;

wherein the top edge of the first elastic net defines an opening, the top edge of the second elastic net is connected to the bottom edge of the first elastic net, the top edge of the elastic belt is connected to the bottom edge of the second elastic net, and the bottom edge of the elastic belt defines an opening through which a user's head is inserted during use;

wherein the second elastic net comprises first and second segments, the first segment having a portion extending along the anterior portion and a second portion extending along first and second end portions of the posterior portion, the second segment extends along the posterior portion and at least partially overlaps with the second portion of the first segment; and a posterior opening disposed between a section of the top edge of the elastic belt and the second segment of the second elastic net;

wherein while being worn by the user, the first elastic net extends along an uppermost portion of the head of the user, and the elastic belt-shaped member is arranged proximate to the hairline; and wherein an elastic modulus of the second elastic net is higher than an elastic modulus of the first elastic net.

2. The wig foundation net according to claim 1, wherein the second elastic net is a knitted item formed by Zokki knitting or interlacing knitting using elastic fibers, and has a finer mesh than that of the first elastic net.

3. The wig foundation net according to claim 1, wherein a layer made of a rubber material or an elastomer material is formed on an exterior surface of the elastic belt.

4. The wig foundation net according to claim 1, wherein the opening of the first elastic net is configured to allow hairs of the user to be pulled therethrough.

5. The wig foundation net according to claim 4, further comprising: a latching member configured to form the elastic belt into an annular shape, and to adjust a length of the annular elastic belt.

6. The wig foundation net according to claim 5, wherein while being worn by the user, the latching member is configured to hold hairs of the user pulled through the opening of the first elastic net.

7. The wig foundation net according to claim 1, wherein an elastic modulus of the elastic belt is higher than the elastic modulus of the second elastic net.

* * * * *